US012805567B2

(12) United States Patent
Peng et al.

(10) Patent No.: US 12,805,567 B2
(45) Date of Patent: Nov. 24, 2026

(54) ATOMIZER AND AEROSOL GENERATING DEVICE

(71) Applicant: SHENZHEN WOODY VAPES TECHNOLOGY CO., LTD., Shenzhen (CN)

(72) Inventors: Yongwen Peng, Shenzhen (CN); Youming Liu, Shenzhen (CN); Yanming Niu, Shenzhen (CN)

(73) Assignee: SHENZHEN WOODY VAPES TECHNOLOGY CO., LTD., Shenzhen (CN)

( * ) Notice: Subject to any disclaimer, the term of this patent is extended or adjusted under 35 U.S.C. 154(b) by 350 days.

(21) Appl. No.: 18/678,940

(22) Filed: May 30, 2024

(65) Prior Publication Data

US 2025/0098750 A1 Mar. 27, 2025

(30) Foreign Application Priority Data

Sep. 21, 2023 (CN) ..... 202322606253.0

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/485; A24F 40/10; A24F 40/42
See application file for complete search history.

(56) References Cited

U.S. PATENT DOCUMENTS

2019/0307174 A1* 10/2019 Qiu ..... A24F 40/40
2021/0212376 A1* 7/2021 Liu ..... A24F 40/60

* cited by examiner

*Primary Examiner* — Michael H. Wilson
*Assistant Examiner* — Jennifer A Kessie
(74) *Attorney, Agent, or Firm* — PV IP PC; Wei Te Chung

(57) ABSTRACT

Disclosed are an atomizer and an aerosol generating device. The atomizer includes a housing, a central tube, a first liquid storage member, an atomizing tube, a second liquid storage member, and a heating element. The central tube is mounted in the housing, and a first liquid storage chamber is formed between the housing and the central tube. The atomizing tube is disposed in the central tube, and a second liquid storage chamber is formed between the atomizing tube and the central tube. The first liquid storage member is located in the second liquid storage chamber, and the second liquid storage member is disposed in the atomizing tube. A liquid inlet is disposed on the central tube, and a liquid passing hole is disposed on a wall of the atomizing tube. The heating element is disposed in the second liquid storage member.

20 Claims, 5 Drawing Sheets

A

Cross-sectional along Y-Y

ATOMIZER AND AEROSOL GENERATING DEVICE

CROSS-REFERENCE TO RELATED DISCLOSURES

This disclosure claims priority to Chinese Patent Application No. 202322606253.0, filed on Sep. 21, 2023, the disclosure of which is incorporated herein by reference in its entirety.

TECHNICAL FIELD

This disclosure relates to the field of atomization technology, and more particularly relates to an atomizer and an aerosol generating device.

BACKGROUND

Conventional atomizers generally have a structure in which silicone is used to separate liquid from an atomizing tube so as to achieve seal and to prevent from liquid leakage. When the atomizer is in use, it is required to release the silicone, and then the liquid is communicated with a liquid inlet of the atomizing tube for a few of minutes, until the inner winding cotton is completely wetted by the liquid. As a result, the structure may take time when use and result in poor user experience.

SUMMARY

Embodiments of the present disclosure provide an atomizer and an aerosol generating device, which solve the deficiencies of the prior art and improve user experience.

According to a first aspect, an embodiment of the present disclosure provides an atomizer comprising a housing, a central tube, a first liquid storage member, an atomizing tube, a second liquid storage member, and a heating element. The central tube is mounted in the housing, and a first liquid storage chamber is formed between the housing and the central tube. The atomizing tube is disposed in the central tube, and a second liquid storage chamber is formed between the atomizing tube and the central tube. The first liquid storage member is located in the second liquid storage chamber. A liquid inlet is disposed on the central tube to communicate the first liquid storage chamber with the second liquid storage chamber, and a liquid passing hole is disposed on a wall of the atomizing tube to communicate with the second liquid storage chamber. The second liquid storage member is disposed in the atomizing tube. The heating element is disposed in the second liquid storage member, and the second liquid storage member is configured to supply liquid to the heating element.

According to a second aspect, an embodiment of the present disclosure provides an aerosol generating device comprising the atomizer as described above.

BRIEF DESCRIPTION OF THE DRAWINGS

Embodiments of the present disclosure are described clearly with reference to accompanying drawings. It is apparent that the drawings in the following description illustrate merely some of the embodiments of the present disclosure, and other drawings can be made from these drawings without involving any inventive effort for those skilled in the art.

The present disclosure and its advantages are described in conjunction with the accompanying drawings. In the following description, like reference numerals refer to like parts.

DETAILED DESCRIPTION

Embodiments of the present disclosure will be described with reference to accompanying drawings. It will be apparent that the described embodiments are only part of, and not all of the embodiments of the present disclosure. All other embodiments provided based on the embodiments in the present disclosure by a person skilled in the art without involving any inventive effort are within the scope of the present disclosure.

Figure 1:
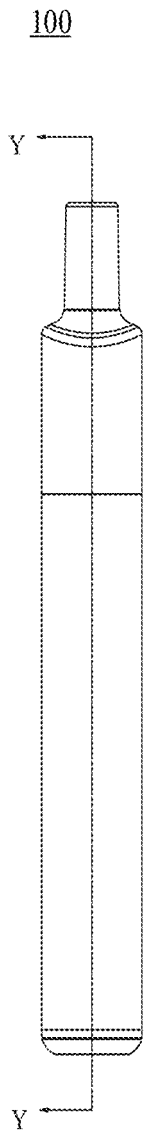
FIG. 1 is a perspective view of an atomizer according to some embodiments of the present disclosure.
Figure 2:
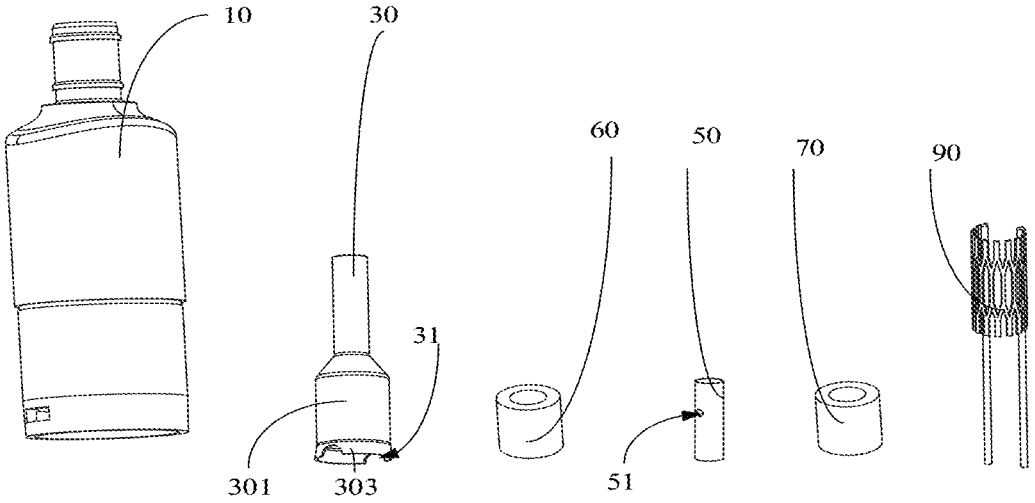
FIG. 2 is an exploded view of the atomizer shown in FIG. 1.
Figure 3:
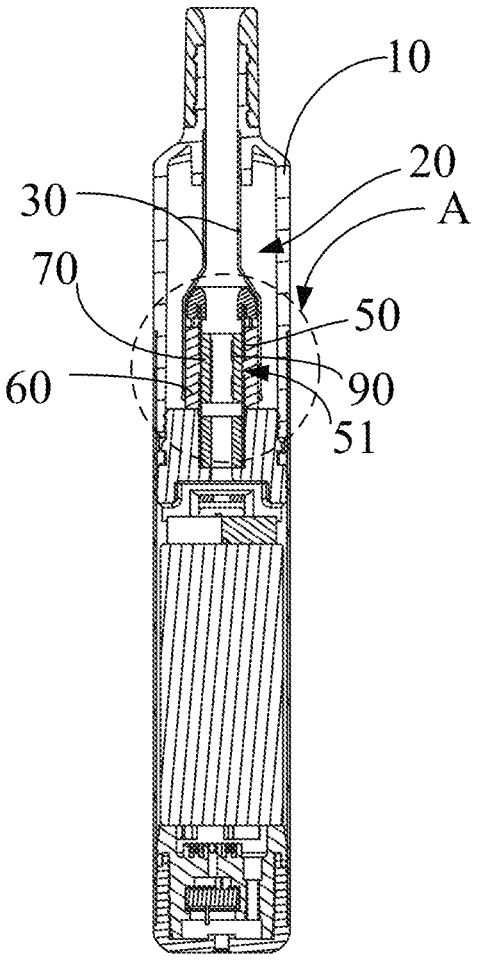
FIG. 3 is a cross-sectional view of the atomizer shown in FIG. 1 in the Y-Y direction.

Referring to FIGS. 1 and 2, FIG. 1 is a perspective view of an atomizer according to some embodiments of the present disclosure, and FIG. 2 is an exploded view of the atomizer shown in FIG. 1. An embodiment of the present disclosure provides an atomizer 100, which may include a housing 10, a central tube 30, a first liquid storage member 60, an atomizing tube 50, a second liquid storage member 70, and a heating element 90. For example, the first liquid storage member is a structure that can absorb and store liquid to be contacted, for example, a porous fiber. The heating element is used to generate heat, and may be, for example, a metal heating wire. Referring to FIG. 3, it is a cross-sectional view of the atomizer shown in FIG. 1 taken in the Y-Y direction. The central tube 30 is mounted in the housing, and a first liquid storage chamber 20 is formed between the central tube 30 and the housing 10. The atomizing tube 50 is disposed in the central tube 30, and a second liquid storage chamber 40 is formed between the central tube 30 and the atomizing tube 50. The first liquid storage member 60 is located in the second liquid storage chamber 40. A liquid inlet 31 is disposed on the central tube 30 to communicate the first liquid storage chamber 20 with the second liquid storage chamber 40. A liquid passing hole 51 is disposed on a wall of the atomizing tube 50 to communicate with the second liquid storage chamber 40. The second liquid storage member 70 is disposed in the atomizing tube 50, and the heating element 90 is disposed in the second liquid storage member 70. The second liquid storage member 70 is configured to supply liquid to the heating element 90. For example, the second liquid storage member is a structure that can absorb and store liquid to be contacted, for example, a porous fiber.

Figure 4:
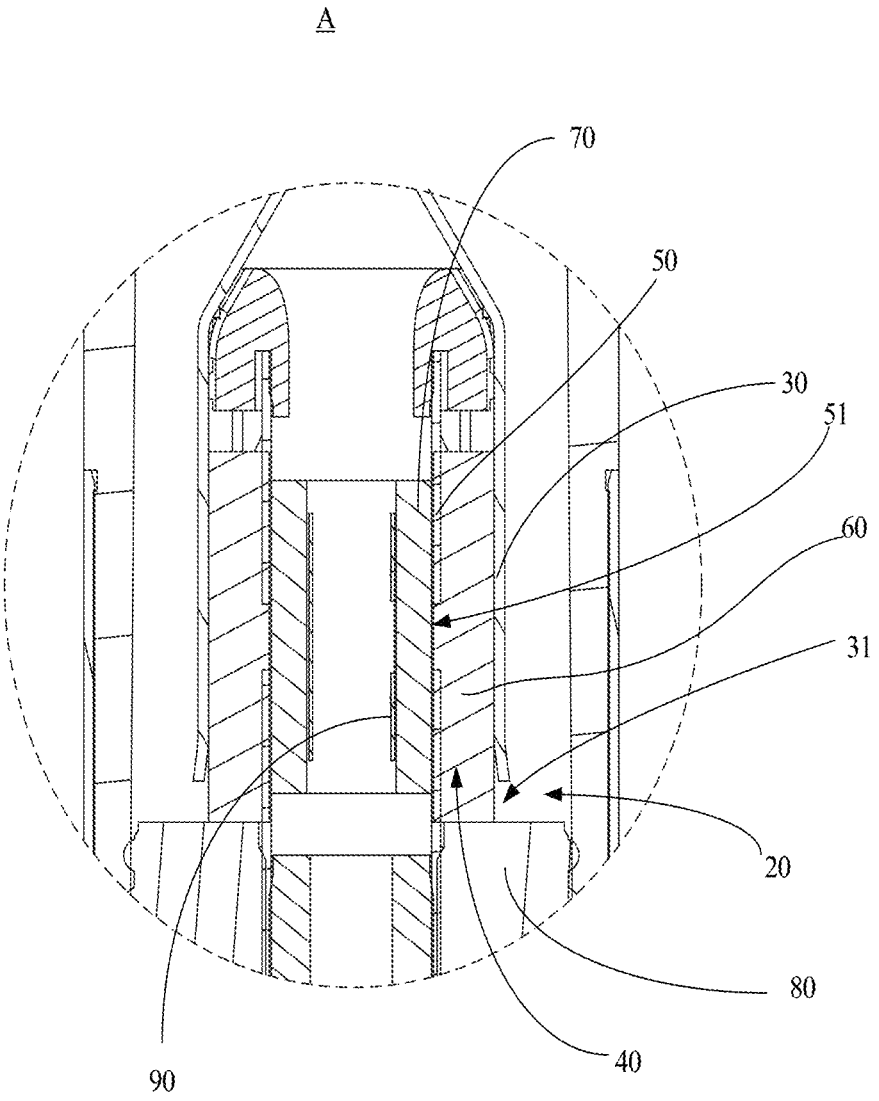
FIG. 4 is a partially enlarged view of Portion A in the atomizer shown in FIG. 3.

The central tube 30 is mounted in the housing, and the first liquid storage chamber 20 is formed between the central tube 30 and the housing 10 to store liquid, especially oil. For example, the liquid may include E-liquid, tabacco oil or the like. The atomizing tube 50 is disposed in the central tube 30, and the second liquid storage chamber 40 is formed between the atomizing tube 50 and the central tube 30. The first liquid storage member 60 is located in the second liquid storage chamber 40, and can store liquid entered into the second liquid storage chamber 40. The liquid inlet 31 is disposed on the central tube 30 to communicate the first liquid storage chamber 20 with the second liquid storage chamber 40, so that liquid in the first liquid storage chamber 20 enters the second liquid storage chamber 40 through the liquid inlet 31 of the central tube 30. The liquid stored in the first liquid storage chamber 20 can be supplied to the second liquid storage chamber 40, and the liquid entered into the second liquid storage chamber 40 is stored by the first liquid storage member 60. The liquid-passing hole 51 is disposed on the wall of the atomizing tube 50 to communicate with the second liquid storage chamber 40, the second liquid storage member 70 is disposed in the atomizing tube 50, and the heating element 90 is provided in the second liquid storage member 70. The second liquid storage member 70 is used to supply liquid to the heating element 90. The heating element 90 provides heat, e.g., by electricity to atomizes the liquid supplied by the second liquid storage member 70. To facilitate the supply of liquid to the heating element 90, the heating element 90 may be disposed against the liquid passing hole 51. In some embodiments, the liquid passing hole 51 may be located at a position on the atomizing tube 50 corresponding to the center of the heating element 90. Referring to FIG. 4, the heating element 90 may be provided in a manner of a plurality of segments, for example, two segments along an extension direction of the second liquid storage member 70, both of which are disposed adjacent to the liquid passing hole 51.

It is to be understood that the first liquid storage member 60 may play a role of storing liquid and controlling a liquid flow rate, and in turn controlling a liquid feed speed. When an appropriate flow rate needs to be set between the first liquid storage chamber 20 and the second liquid storage chamber 40, at least one of factors comprising the number of layers, density, volume, or other parameters of the first liquid storage member 60 may be changed to adjust the liquid flow rate. The second liquid storage member 70 also exerts the effect of storing liquid and controlling flow rate, and in turn controlling a liquid feed speed. When an appropriate flow rate needs to be set between the second liquid storage chamber 40 and the heating element 90, at least one of factors comprising the number of layers, density, volume, or other parameters of the second liquid storage member 70 may be changed to adjust the liquid flow rate. The adjustment of the position of the liquid-passing hole 51 may also be used to control the liquid feed speed. When the liquid feed speed needs to be increased, the liquid passing hole 51 may be disposed at a position relatively close to the liquid inlet 31. When the liquid feed speed needs to be decreased, the liquid passing hole 51 may be disposed at a position relatively far from the liquid inlet 31. In addition, the liquid feed speed may be controlled by changing an area of the liquid inlet 31, for example, enlarging the area of the liquid inlet 31 to increase the liquid feed speed, or lessening the area of the liquid inlet 31 to reduce the liquid feed speed. The liquid feed speed can also be controlled by changing an area of the liquid passing hole 51, for example, enlarging the area of the liquid passing hole 51 to increase the liquid feed speed, or lessening the area of the liquid passing hole 51 to reduce the liquid feed speed. As a result, an appropriate amount of liquid may be supplied to the heating element 90 through the liquid inlet 31, the first liquid storage member 60, the liquid passing hole 51, and the second liquid storage member 70, by the cooperation of the liquid inlet 31, the first liquid storage member 60, the liquid passing hole 51, and the second liquid storage member 70, and then the liquid supplied from the second liquid storage member 70 can be heated and atomized by the heating element 90 after being heated.

Conventional atomizers generally have a structure in which silicone is used to separate liquid from an atomizing tube, so as to achieve seal and to prevent from liquid leakage. When the atomizer is in use, it is required to release the silicone, and then the liquid is communicated with a liquid inlet of the atomizing tube for a few of minutes, until the inner winding cotton is completely wetted by the liquid. As a result, the structure may take time when use and result in poor user experience. However, in the atomizer according to the embodiments of the present disclosure, the liquid in the first liquid storage chamber enters the second liquid storage chamber through the liquid inlet and is stored by the first liquid storage member in the second liquid storage chamber. Then, the liquid in the first liquid storage member in the second liquid storage chamber enters the second liquid storage member through the liquid passing hole, and is stored by the second liquid storage member for supplying to the heating element. Therefore, the liquid is supplied to the heating element after going through the first liquid storage member and the second liquid storage member, which are capable of storing liquid and controlling the liquid flow rate. The first liquid storage member can retard the flow of liquid and provide an appropriate amount of liquid to the second liquid storage member, so that the second liquid storage member can supply an appropriate amount of liquid to the heating element normally without excessive liquid supply and damage to the circuit board due to liquid leakage. As a result, the atomizer can be used at any time, with no liquid leakage, and it is easy to transport and store the liquid, thereby solving the problem of the need of removing the silicone and waiting for a few minutes before use of the atomizer in the related art, and bringing a better experience to a user.

Figure 5:
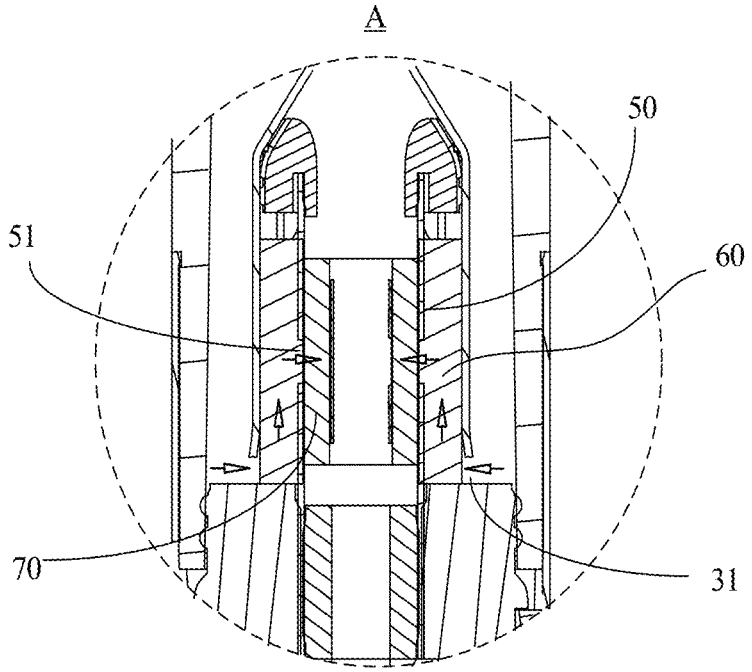
FIG. 5 is a schematic view of liquid flow in the atomizer of FIG. 4.

FIG. 5 is a schematic view of the liquid flow in the atomizer shown in FIG. 4. The arrows in FIG. 5 indicate the flow direction of the liquid. The liquid in the first liquid storage chamber 20 enters the second liquid storage chamber 40 through the liquid inlet 31, and is stored by the first liquid storage member 60 in the second liquid storage chamber 40. A part of the liquid in the wetted first liquid storage member 60 enters the second liquid storage member 70 through the liquid passing hole 51, and is stored by the second liquid storage member 70 to supply liquid to the heating element 90. The liquid inlet 31, the first liquid storage member 60, the liquid passing hole 51, and the second liquid storage member 70 can play a role in controlling the liquid flow, and the first liquid storage member 60 and the second liquid storage member 70 are also capable of storing the liquid, so that the second liquid storage member 70 can supply an appropriate amount of the liquid to the heating element normally without excessive liquid supply and damage to the circuit board. Therefore, the atomizer can be used at any time, ensuring no liquid leakage and easy for the liquid to be transported and stored.

With continued reference to FIGS. 3 and 4, in some embodiments, the liquid inlet is disposed at the bottom of the central tube. When the liquid inlet 31 is disposed at the bottom of the central tube 30, the liquid stored in the first liquid storage chamber 20 can be sufficiently sucked and stored by the first liquid storage member, so that the liquid stored in the first liquid storage chamber 20 can be fully utilized.

In some embodiments, in order to enable the first liquid storage chamber 20 to supply an appropriate amount of liquid to the first liquid storage member 60 in the second liquid storage chamber 40, the liquid inlet 31 may be set to have an area of 2 $mm^2$ to 35 $mm^2$, which can supply an appropriate amount of liquid to the first liquid storage member 60 in the second liquid storage chamber 40, thereby ensuring that the second liquid storage member 70 can supply an appropriate amount of liquid to the heating element normally, without excessive liquid supply and damage to the electronic circuit board due to liquid leakage. In some embodiments, the liquid inlet 31 may include a plurality of sub-liquid inlets, and the sum of area of the plurality of sub-liquid inlets is the area of the liquid inlet 31. For example, the area of the liquid inlet 31 may be 2 $mm^2$, 5 $mm^2$, 7 $mm^2$, 10 $mm^2$, 12 $mm^2$, 14 $mm^2$, 17 $mm^2$, 19 $mm^2$, 20 $mm^2$, 22 $mm^2$, 25 $mm^2$, 30 $mm^2$, 34 $mm^2$, or 35 $mm^2$. In some embodiments, the area of the liquid inlet 31 may be 5 $mm^2$ to 25 $mm^2$, and for example, may be 5 $mm^2$, 7 $mm^2$, 10 $mm^2$, 12 $mm^2$, 14 $mm^2$, 17 $mm^2$, 19 $mm^2$, 20 $mm^2$, 22 $mm^2$, or 25 $mm^2$. In some embodiments, the area of the liquid inlet 31 may be 14 $mm^2$.

With continued reference to FIGS. 3 and 4, in an embodiment, the atomizer further includes a sealing base 80 on which the central tube 30, the atomizing tube 50, and the second liquid storage member 70 are all mounted. The first liquid storage chamber 20 is formed by the sealing base 80, the housing 10, and the central tube 30. The first liquid storage chamber 60 is abutted between the central tube 30 and the atomizing tube 50, and the bottom of the first liquid storage chamber 60 abuts against the sealing base 80.

The bottom of the first liquid storage member 60 abuts against the sealing base 80, so that all of the liquid to be supplied can enter the first liquid storage member 60 through the liquid inlet 31 to avoid leakage from the bottom, leading to accurate liquid inlet amount, and the liquid entering into the second liquid storage chamber can be directly absorbed and stored by the first liquid storage member. In some embodiments, the sealing base 80 may be made from liquid-isolating materials, such as silicone or rubber. The sealing base 80 is used for sealing and preventing liquid leakage. The sealing base 80 may be located at the bottom of the central tube 30, the first liquid storage member 60, the atomizing tube 50, the second liquid storage member 70, and the heating element 90. The first liquid storage chamber 20 is formed by the sealing base 80, the housing 10 and the central tube 30. Thus, the liquid is stored in the first liquid storage chamber 20, and then enters the second liquid storage chamber 40 through an opening (i.e., the liquid inlet 31) between the central tube 30 and the sealing base 80, and is stored in the first liquid storage member 60. The liquid inlet 31 is disposed at an end of the central tube close to the sealing base. The liquid stored in the first liquid storage chamber 20 can be sufficiently absorbed and stored by the first liquid storage member so that the liquid stored in the first liquid storage chamber 20 can be fully utilized.

In the specific installation, the heating element 90, the second liquid storage member 70, the atomizing tube 50, and the first liquid storage member 60 may be assembled into a first assembly, and the sealing base 80 is installed at the bottom of the first assembly. Then, the first assembly is installed into the inner of the central tube 30 from a side of the central tube 30 that is provided with the liquid inlet 31. An opening for liquid inlet is provided between the liquid inlet 31 on the central tube 30 and the sealing base 80, and the liquid from the liquid inlet 31 is stored in the first liquid storage member 60.

In some embodiments, the central tube 30 includes a central tube body 301 and a guide portion 303. The guide portion 303 is fixed to the central tube body 301 and extends toward the sealing base. The guide portion 303 is trumpet-shaped, and the liquid inlet 31 is provided at an end of the guide portion 303 away from the central tube body 301.

In this embodiment, the central tube 30 includes the central tube body 301 and the guide portion 303, the guide portion 303 is fixed to the central tube body 301 and extends toward the sealing base, and the guide portion 303 is trumpet-shaped. It is readily understood that as the guide portion 303 extends toward the sealing base, the diameter of the opening of the guide portion 303 becomes larger, and the trumpet-shaped guide portion 303 can guide the first assembly when the first assembly is to be installed into the interior of the central tube 30 from the side of the central tube 30 that is provided with the liquid inlet 31, thereby facilitating the installment. The liquid inlet 31 is provided at the end of the guide portion 303 away from the central tube body 301.

In an embodiment, the liquid passing hole 51 and the liquid inlet 31 are spaced apart in an axial direction of the atomizing tube 50. In this embodiment, the liquid passing hole 51 and the liquid inlet 31 are spaced apart in the axial direction of the atomizing tube 50, so that the liquid that enters the second liquid storage chamber 40 through the liquid passing hole 51 from the first liquid storage chamber 20 is adsorbed by the first liquid storage member 60 and guided for a certain distance, before it enters the second liquid storage member 70 through the liquid passing hole 51 formed on the atomizing tube 50, so that the amount of liquid entering the second liquid storage member 70 is controlled as needed, and the second liquid storage member 70 can supply an appropriate amount of liquid to the heating element normally, without excessive liquid supply and damage to the electronic circuit board due to liquid leakage, thereby enabling an user to use the atomizer 100 at any time, ensuring that the product is free from liquid leakage and facilitating transportation and storage.

In an embodiment, the liquid inlet 31 includes a plurality of sub-liquid inlets that are disposed at intervals at the bottom of the central tube. In this embodiment, the liquid stored in the first liquid storage chamber 20 enters the second liquid storage chamber 40 through the plurality of sub-liquid inlets and is stored in the first liquid storage member 60, and the plurality of sub-liquid inlets 31 are spaced apart at the bottom of the central tube so that the liquid enters the first liquid storage member 60 from the periphery, thereby making the liquid stored in the first liquid storage member 60 uniform. In an embodiment, the number of the sub-liquid inlets 31 may be four, and the four sub-liquid inlets 31 are disposed symmetrically at the bottom of the central tube 30.

In an embodiment, the liquid passing hole 51 includes a plurality of sub-liquid passing holes that are disposed at intervals on the wall of the atomizing tube 50. In this embodiment, the liquid stored in the first liquid storage member 60 in the second liquid storage chamber 40 enters the second liquid storage member 70 through the plurality of sub-liquid passing holes that are disposed at intervals on the wall of the atomizing tube 50, so that the liquid enters the second liquid storage member 70 from the periphery, thereby making the liquid stored in the second liquid storage member 70 uniform. In an embodiment, the number of the plurality of sub-liquid passing holes may be two, and the plurality of sub-liquid passing holes are symmetrically formed on the wall of the atomizing tube 50. In order to control the liquid inlet and the liquid inlet amount from the liquid passing hole, the area of the liquid passing hole may be less than the area of the liquid inlet. The area of the liquid passing hole may be 2 $mm^2$ to 35 $mm^2$. It is readily understood that the liquid passing hole may include the plurality of sub-liquid passing holes, and the sum of the areas of the plurality of sub-liquid passing holes is the area of the liquid passing hole, which is 2 $mm^2$ to 35 $mm^2$. Specifically, the area of the liquid passing hole may be 2 $mm^2$, 5 $mm^2$, 7 $mm^2$, 10 $mm^2$, 12 $mm^2$, 14 $mm^2$, 17 $mm^2$, 19 $mm^2$, 20 $mm^2$, 22 $mm^2$, 25 $mm^2$, 30 $mm^2$, 34 $mm^2$, 35 $mm^2$, or the like. In some embodiments, the area of the liquid passing hole may be 5 $mm^2$ to 25 $mm^2$, specifically, 5 $mm^2$, 7 $mm^2$, 10 $mm^2$, 12 $mm^2$, 14 $mm^2$, 17 $mm^2$, 19 $mm^2$, 20 $mm^2$, 22 $mm^2$, 25 $mm^2$, or the like. In some embodiments, the area of the liquid passing hole may be 14 $mm^2$.

In an embodiment, the liquid storage volume of the second liquid storage member 70 is less than that of the first liquid storage member 60 in order to facilitate control of the liquid feed speed and the amount of liquid supplied to the heating element 90 by the second liquid storage member 70. For example, the liquid storage volume of the first liquid storage member 60 is 0.05 ml to 2 ml, and specifically 0.05 ml, 0.1 ml, 0.5 ml, 1 ml, 1.05 ml, 1.1 ml, 1.2 ml, 1.5 ml, 1.7 ml, 2 ml, or the like. The liquid storage volume of the second liquid storage member 70 is 0.05 ml to 1 ml, and specifically 0.05 ml, 0.1 ml, 0.5 ml, 1 ml, or the like.

In an embodiment, the second liquid storage member 70 includes a plurality of sublayers that are attached in the radial direction of the atomizing tube 50. As such, the liquid passes through the plurality of sublayers that are attached in the radial direction of the atomizing tube 50 and then heated by the heating element 90. Thus, the liquid feed speed and the amount of liquid supplied to the heating element 90 by the second liquid storage member 70 can be controlled.

In an embodiment, the number of the sublayers may be 4 to 8 layers. The 4 to 8 sublayers are attached in the radial direction of the atomizing tube. Specifically, the number of the sublayers may be 4 layers, 5 layers, 6 layers, 7 layers, or 8 layers.

In the atomizer provided in the embodiments of the present disclosure, liquid in the first liquid storage chamber enters the second liquid storage chamber through the liquid inlet and is stored by the first liquid storage member in the second liquid storage chamber. The liquid in the first liquid storage member in the second liquid storage chamber enters the second liquid storage member through the liquid passing hole and is stored by the second liquid storage member, and then is supplied to the heating element. The liquid needs to be supplied to the heating element through the first liquid storage member and the second liquid storage member. The first liquid storage member and the second liquid storage member are capable of storing liquid and limiting the flow of liquid. The first liquid storage member can retard the flow of liquid and provide an appropriate amount of liquid to the second liquid storage member, so that the second liquid storage member can supply an appropriate amount of liquid to the heating element normally without excessive liquid supply and damage to the electronic circuit board due to liquid leakage, which may realize the use of the atomizer at any time, but also ensure no leakage of liquid of the product, easy to transport and storage the atomizer, thereby solving the problem of the need of removing the silicone and waiting for a few minutes before use in the related art.

Embodiments of the present disclosure also provide an aerosol generating device, which includes an atomizer as described in any of the above embodiments. The structure and function of the atomizer have been discussed in detail above and will not be repeated here. Since the aerosol generating device includes the atomizer according to any one of the above embodiments, the aerosol generating device also has the structure and function of the atomizer according to any one of the above embodiments. The aerosol generating device can be used at any time, but also can ensure no liquid leakage, thereby it is convenient for transport and storage and brings better use experience.

In the above embodiments, the description of each embodiment has its own emphasis, and parts not described in detail in a certain embodiment may be referred to the related description in other embodiments.

In the description of the present disclosure, the terms "first" or "second" are used for descriptive purposes only, and are not to be understood as indicating or implying relative importance or implicitly specifying the number of technical features represented. As a result, the feature defined with "first" or "second" may expressly or implicitly include one or more features.

The atomizer and aerosol generating device according to the embodiments of the present disclosure have been described in detail, and specific examples are applied herein to illustrate the principles and implementations of the present disclosure. The description of the above embodiments is merely provided to help understand the method of the present disclosure and the core idea thereof. Variations may be made for those skilled in the art in specific implementations and scope of the application in accordance with the teachings of the present disclosure. In summary, the present description should not be construed as limiting the disclosure.

What is claimed is:

1. An atomizer comprising a housing, a central tube, a first liquid storage member, an atomizing tube, a second liquid storage member, and a heating element, wherein the central tube is mounted in the housing, a first liquid storage chamber is formed between the housing and the central tube, the atomizing tube is disposed in the central tube, a second liquid storage chamber is formed between the atomizing tube and the central tube, the first liquid storage member is located in the second liquid storage chamber, a liquid inlet is disposed on the central tube to communicate the first liquid storage chamber with the second liquid storage chamber, a liquid-passing hole is disposed on a wall of the atomizing tube to communicate with the second liquid storage chamber, the second liquid storage member is disposed in the atomizing tube, the heating element is disposed in the second liquid storage member, and the second liquid storage member is configured to supply liquid to the heating element.

2. The atomizer according to claim 1, wherein an area of the liquid inlet is in a range of 2 $mm^2$ to 35 $mm^2$.

3. The atomizer according to claim 1, further comprising a sealing base on which the central tube, the atomizing tube, and the second liquid storage member are mounted, wherein the first liquid storage chamber is formed by the sealing base, the housing, and the central tube, the first liquid storage member is abutted between the central tube and the atomizing tube, and a bottom of the first liquid storage member is abutted against the sealing base.

4. The atomizer according to claim 3, wherein the liquid inlet is disposed at an end of the central tube adjacent to the sealing base.

5. The atomizer according to claim 1, wherein the liquid-passing hole and the liquid inlet are spaced apart in an axial direction of the atomizing tube.

6. The atomizer according to claim 4, wherein the liquid-passing hole and the liquid inlet are spaced apart in an axial direction of the atomizing tube.

7. The atomizer according to claim 4, wherein the central tube includes a central tube body and a guide portion, the guide portion is fixed to the central tube body and extends toward the sealing base, the guide portion is trumpet-shaped, and the liquid inlet is provided at an end of the guide portion away from the central tube body.

8. The atomizer according to claim 1, wherein the liquid inlet comprises a plurality of sub-liquid inlets, and the plurality of sub-liquid inlets are provided at intervals at a bottom of the central tube.

9. The atomizer according to claim 1, wherein the liquid passing hole comprises a plurality of sub-liquid passing holes, and the plurality of sub-liquid passing holes are provided at intervals on the wall of the atomizing tube.

10. The atomizer according to claim 1, wherein a liquid storage volume of the second liquid storage member is less than that of the first liquid storage member.

11. The atomizer according to claim 1, wherein the second liquid storage member comprises a plurality of sublayers, and the plurality of sublayers are attached on the atomizing tube in a radial direction.

12. The atomizer according to claim 10, wherein the liquid storage volume of the first liquid storage member is in a range of 0.05 ml to 2 ml.

13. The atomizer according to claim 10, wherein the liquid storage volume of the second liquid storage member is in a range of 0.05 ml to 1 ml.

14. The atomizer according to claim 11, wherein the sublayers comprise 4 to 8 layers that are attached on the atomizing tube in the radial direction.

15. An aerosol generating device comprising an atomizer, wherein the atomizer comprises a housing, a central tube, a first liquid storage member, an atomizing tube, a second liquid storage member, and a heating element, wherein the central tube is mounted in the housing, a first liquid storage chamber is formed between the housing and the central tube, the atomizing tube is disposed in the central tube, a second liquid storage chamber is formed between the atomizing tube and the central tube, the first liquid storage member is located in the second liquid storage chamber, a liquid inlet is disposed on the central tube to communicate the first liquid storage chamber with the second liquid storage chamber, a liquid passing hole is disposed on a wall of the atomizing tube to communicate with the second liquid storage chamber, the second liquid storage member is disposed in the atomizing tube, the heating element is disposed in the second liquid storage member, and the second liquid storage member is configured to supply liquid to the heating element.

16. The aerosol generating device according to claim 15, wherein an area of the liquid inlet is in a range of 2 $mm^2$ to 35 $mm^2$.

17. The aerosol generating device according to claim 15, further comprising a sealing base on which the central tube, the atomizing tube, and the second liquid storage member are mounted, wherein the first liquid storage chamber is formed by the sealing base, the housing, and the central tube, the first liquid storage member is abutted between the central tube and the atomizing tube, and a bottom of the first liquid storage member is abutted against the sealing base.

18. The aerosol generating device according to claim 17, wherein the liquid inlet is disposed at an end of the central tube adjacent to the sealing base.

19. The aerosol generating device according to claim 15, wherein the liquid passing hole and the liquid inlet are disposed at intervals in an axial direction of the atomizing tube.

20. The aerosol generating device according to claim 18, wherein the central tube includes a central tube body and a guide portion, the guide portion is fixed to the central tube body and extends toward the sealing base, the guide portion is trumpet-shaped, and the liquid inlet is provided at an end of the guide portion away from the central tube body.

* * * * *